United States Patent [19]

Lulko et al.

[11] Patent Number: 4,820,198

[45] Date of Patent: Apr. 11, 1989

[54] IN-LINE CABLE ASSEMBLY, LOCK BAR THEREFOR

[75] Inventors: Allen R. Lulko, Canton; David A. LesCamela, Mt. Clemens, both of Mich.

[73] Assignee: Chrysler Motors Corporation, Highland Park, Mich.

[21] Appl. No.: 111,908

[22] Filed: Oct. 23, 1987

[51] Int. Cl.[4] ..... H01R 13/40

[52] U.S. Cl. ..... 439/595; 439/599

[58] Field of Search ..... 439/594–599, 439/744, 745, 752

[56] References Cited

U.S. PATENT DOCUMENTS

| | | | |
|---|---|---|---|
| 3,686,619 | 8/1972 | McCardell et al. | 439/595 |
| 4,357,066 | 11/1982 | Cairns et al. | 439/595 |
| 4,431,252 | 2/1984 | Cairns et al. | 439/595 |
| 4,557,542 | 12/1985 | Coller et al. | 439/595 |
| 4,655,525 | 4/1987 | Hunt, III et al. | 439/599 |
| 4,695,112 | 9/1987 | Maston et al. | 439/350 |
| 4,714,437 | 12/1987 | Dyki | 439/595 |

*Primary Examiner*—P. Austin Bradley

*Attorney, Agent, or Firm*—Wendell K. Fredericks

[57] ABSTRACT

A pin terminal secondary locking bar effects locking of keepers in circular slot of pin termainals that have two outer laterally directed triangular shaped fingers and at least one rectangular shaped finger disposed therebetween. The outer fingers are flexed inwardly upon insertion into or removal from a receiving cavity disposed under a housing holding the pins.

2 Claims, 3 Drawing Sheets

IN-LINE CABLE ASSEMBLY, LOCK BAR THEREFOR

BACKGROUND OF THE INVENTION

1. Field of the Invention

This invention relates to cable assemblies and more particularly in a prpeferred embodiment to cable assemblies for in-line connecting of cables to components having in-line plugs, the cable assemblies include female and male pin terminals locked in terminal connectors and plugs, respectively, in a novel manner to prevent the terminals from being forcefully removed.

2. Description of the Prior Art

Prior art assemblies include means for locking terminals in connector and plug housings. Structures in the housings such as resilient material locking fingers which snap into slots in the terminals have been used to hold the terminals in place, providing a primary means for retaining the terminals within the housing. Such an arrangement could not be expected to prevent forceful removal of the terminals from the housings since slightly higher than normal force upon the cables often would be sufficient to cause the pin terminals to deflect the fingers.

In addition to having slotted terminals and resilient material locking fingers for primary retention purposes, secondary locking means have also been used to provide an additional lock for keeping the terminals in place during handling and use. One such secondary locking means is described in U.S. Pat. No. 4,695,112 by Maston, et al. entitled "Printed Circuit Board, Edgeboard Connector Therefor" dated Sept. 22, 1987. There, the connector housing has been provided with a pair of sidewalls with an aperture in each for receiving one of a pair of collapsible nibs of a secondary lock bar. The lock bar includes a pair of collapsible nibs, the nibs being disposed at opposite ends of the lock bar.

Such a lock bar provides adequate secondary locking but the collapsible nibs, under some conditions such as during removal of the terminals, may be awkward to handle and reasonable care is required to prevent damaging the collapsible nibs.

To provide a locking bar suitbale for use as a secondary locking means, it is desirable to provide a bar that can readily be removed from the housing without damage to the housing, the terminals or the primary locking mechanism. Also it is desirable to provide a secondary locking means that can be manufactured with wider tolerances and less material than lock bars such as the one described in the Maston et al. application yet can add enhancing features to the overall performance of the cable assembly.

To obtain the above-mentioned desiderata, a search for various other means to enhance the locking characteristics of the secondary lock bars was initiated. This search resulted in the improved secondary locking devices of the present invention.

SUMMARY OF THE INVENTION

The present invention concerns cable assemblies having in-line connectors for connecting a cable or wires to components or other cable or wires that are terminated by in-line plugs. The connectors and plugs both have housings with terminal receiving channels molded therewithin for receiving female and male pin terminals respectively. A grooved slot encircles a chosen region of each terminal. A resilient material locking finger disposed in each receiving channel engages the slot when a pin terminal is inserted, providing primary locking of the terminals in the housings. A portion of the sidewalls of the housing for both the connectors and the plugs include apertures for receiving the outer edges of the outer, laterally directed, resilient fingers of a plural finger dual function locking bar of this invention. Not only does the locking bar provide secondary locking, which fixedly locks the resilient material locking fingers in the slots of the terminals, the bar of this invention has a plurality of upright struts having concave-shaped distal ends which encircles an under portion of the periphery of the pins and mates with a plurality of arch-shaped, pin receiving channels in a complimentary fashion so as to prevent wobbly movement of the pins when the cable assembly connectors and plugs are joined.

DESCRIPTION OF A PREFERRED EMBODIMENT

Figure 1:
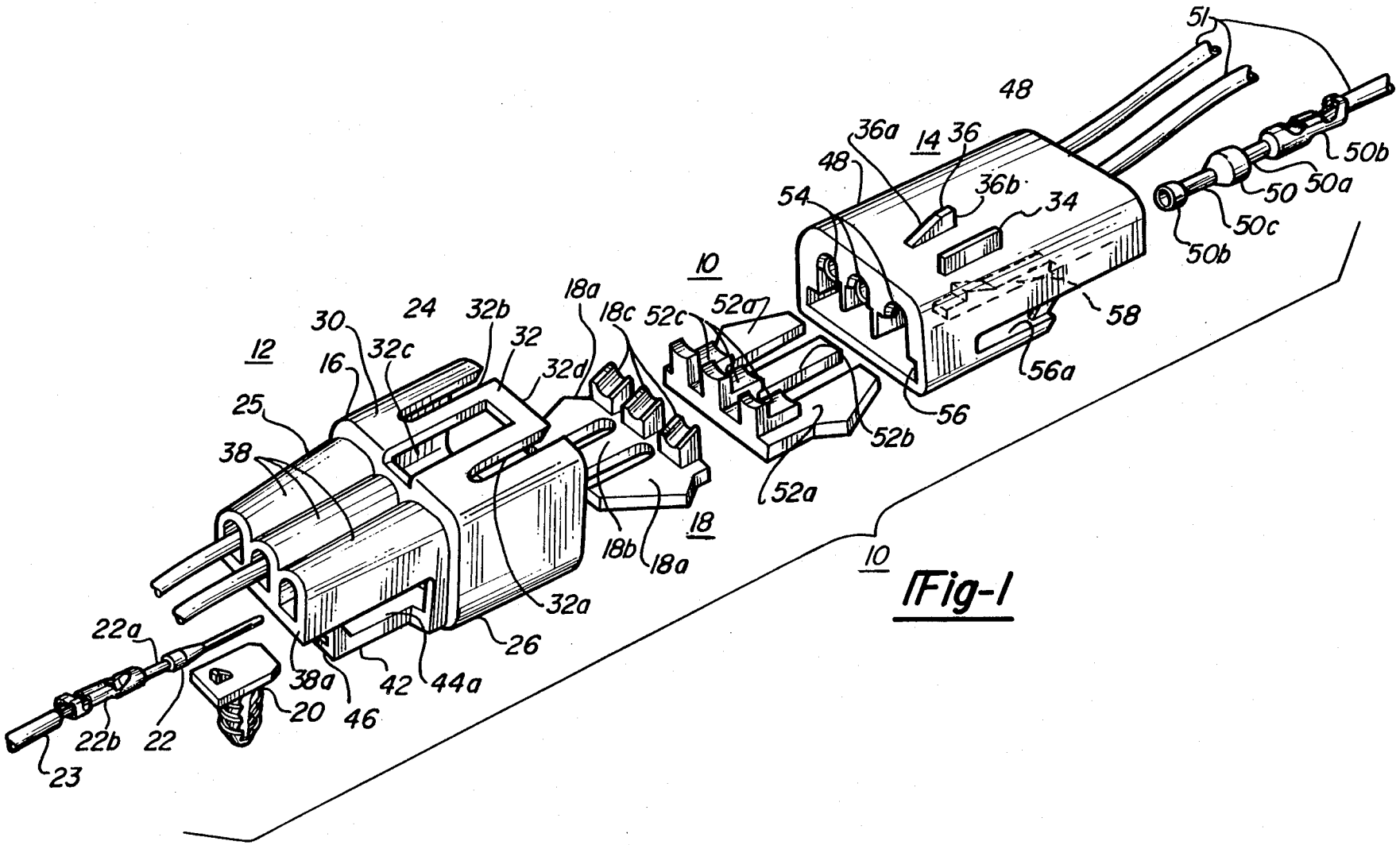
FIG. 1 is a perspective view of an in-line plug and an in-line connector of a cable assembly constructed in accordance with the present invention.

Referring to FIGS. 1 through 6, there is shown in FIG. 1 an in-line plug 12 and an in-line connector 14 of a cable assembly 10.

Plug 12 includes a molded housing 16, a locking bar 18, a mounting post 20 and a plurality of male pin terminals 22. Housing 16 is comprised of two molded dielectric material sections, a front undivided cavity 24 for receiving the connector 14 and a rear divided cavity 25 (see FIG. 1) for receiving a plurality of male pin terminals 22 (see FIG. 3).

Figure 2:
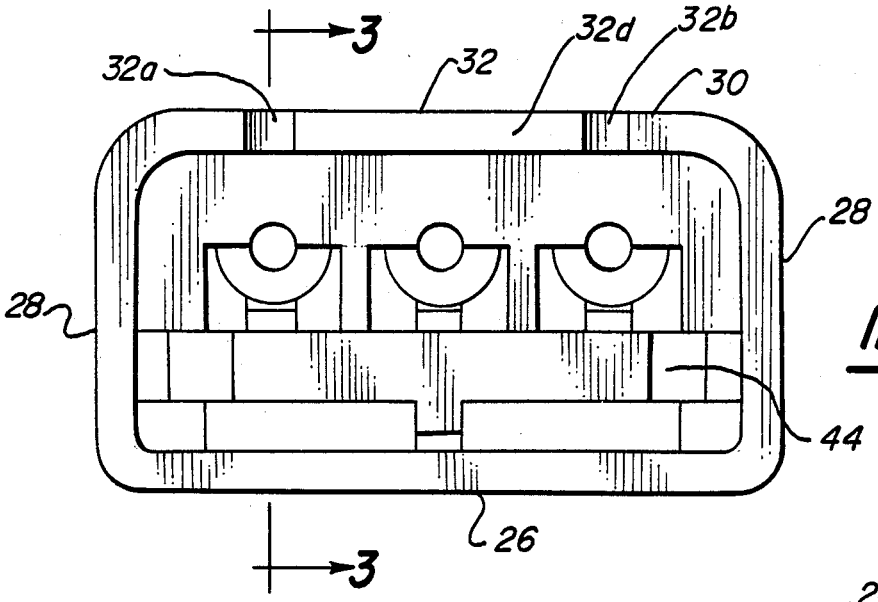
FIG. 2 is a front elevated view of the in-line plug of FIG. 1.
Figure 3:
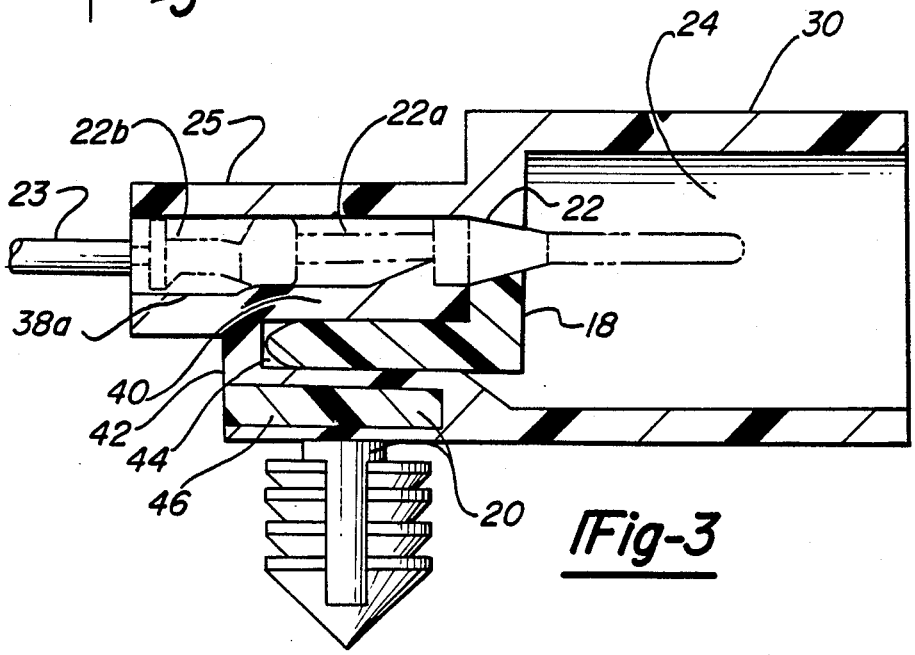
FIG. 3 is a crossectional view of the in-line plug of FIG. 1 taken along the lines 3—3 of FIG. 2 illustrative in particular of the secondary locking arrangement of this invention.
Figure 4:
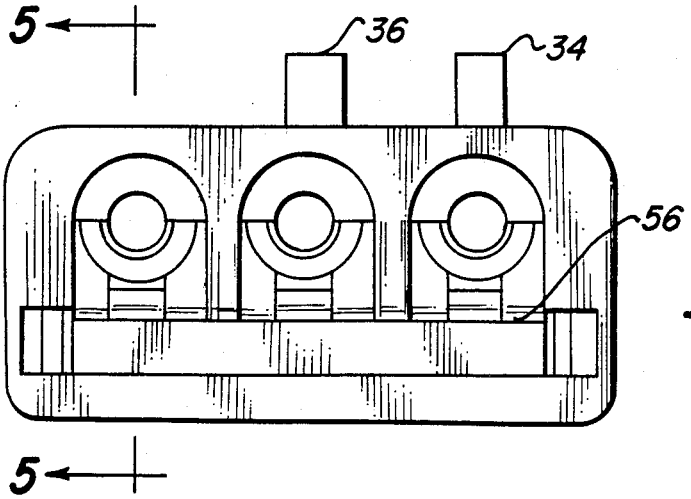
FIG. 4 is a front elevated view of the in-line connector of FIG. 1.
Figure 5:
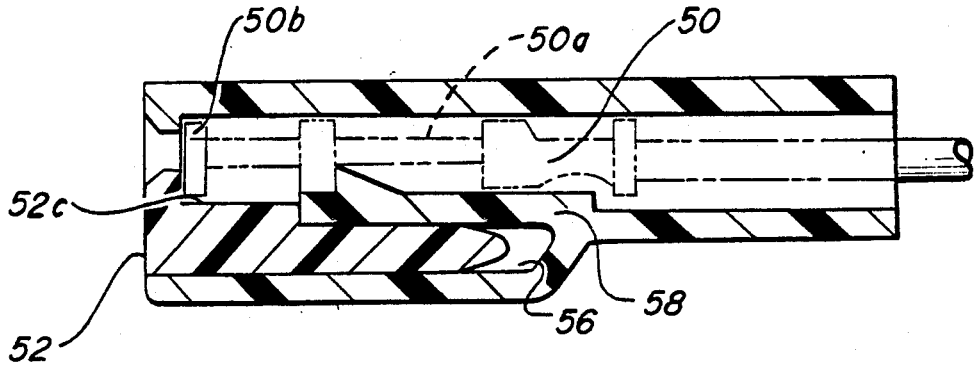
FIG. 5 is a crossectional view of the in-line connector of FIG. 1 taken along the lines 5—5 of FIG. 4 illustrative in particular of the secondary locking arrangement of this invention.
Figure 6:
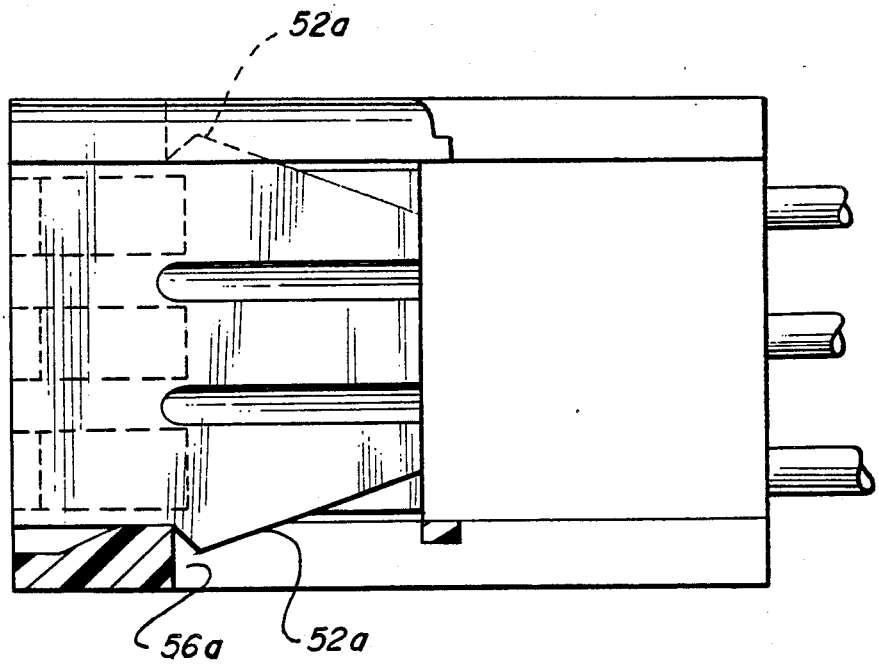
FIG. 6 is a fragmentary top view partially in section depicting interfacing surfaces of the locking bar and the sidewall of the connector housing.

The front undivided cavity 24 is formed between a smooth bottom surface 26, a pair of smooth front side walls 28 and a top surface 30 that has a resilient latch 32 molded integrally in the front cavity between a first and a second slot **32*a* and 32*b* respectively (see FIG. 2). Latch 32 has a latch bar slot 32*c* for receiving a latch bar 36 molded to a central region of a top surface of connector 14. The first slot 32*a* receives a polarity-indicating rib 34, also molded to a top surface of connector 14 adjacent to latch bar 36, when plug 12 is mated with connector 14. Second slot 32*b* operates in concert with the first slot 32*a* to allow latch 32 to flex upward as a front edge 32*d* of latch 32 encounters a wedged front face 36*a* of latch bar 36 and to flex downward over latch bar 36 as the front edge 32*d* glides over and past a flat vertical rear face 36*b* placing latch bar 36 in latch slot 32*c* as plug 12 is mated with connector 14**.

The rear divided cavity 25 is comprised of a plurality of arch-shaped, pin receiving channels 38 that divide the cavity into a plurality of channels. Each channel 38 has a rear partial bottom wall 38*a* from which a resilient material, locking keeper 40 (best seen in FIG. 3) extends from a front portion of the bottom wall 38*a* into the channel such that the keeper 40 engages a circular grooved slot 22*a* at a chosen position along the body of the male pin terminal 22 providing primary locking of the terminal when the terminal is inserted into the receiving channel. Each Terminal 22 also includes a pair of crimping arms 22*b* at a rear end for crimping a wire 23 to terminal 22.

An inclined L-shaped bracket 42 having one end of the base of the "L" shaped bracket depending from the rear portion of the bottom wall 38*a* and a distal end of the leg of the "L" shaped bracket molded to a rear end portion of the bottom surface 26 of the front cavity 24, in a manner forming another cavity 44 (best seen in FIGS. 1 and 3) for receiving the locking bar 18 and which provides a pair of tracks 46 on the underside of bracket 42 for receiving the mounting post 20.

Within both side walls of cavity 44 is an aperture 44*a* for receiving the outer edges of a pair of outer, laterally-directed, triangular shaped, resilient fingers 18*a* of the secondary locking bar 18 which is used to fixedly lock the primary locking keepers 40 in the circular grooved slots 22*a* of the male pin terminals 22. Bar 18 also may have at least one rectangular shaped finger 18*b* that is disposed between the pair of outer fingers 18*a*.

After the terminals 22 have been inserted into the receiving channels 38 and are locked into place by the keeper 40, lock bar 18 is inserted into cavity 44 such that the laterally directed, resilient outer fingers 18*a* flex inwardly upon entry into cavity 44 and then flex outwardly when the outer edges of the fingers 18*a* enter the apertures 44*a* in the sidewalls of cavity 44. A top surface of each finger 18*a* and 18*b* of lock bar 18 encounters a bottom surface of a corresponding primary locking keeper 40 as bar 18 is inserted into cavity 44 to fixedly lock, in a wedge-like manner, each keeper 40 into the slot 22*a* of each male pin terminal 22.

When lock bar 18 has been completely inserted, the male pin end of each terminal is encircled by an upright strut 18*c* disposed at a terminating end of bar 18 which has a concave-shaped distal end that engages an under portion of the periphery of the pin and mates with the arch-shaped, pin receiving channel 38 in a complimentary fashion so as to prevent wobbly movement of the pin end of each terminal when the cable assembly connector and plug are joined.

Female connector 14 is similarly arranged. Connector 14 includes a molded housing 48, a plurality of female-pin terminals 50 and a secondary locking bar 52.

Housing 48 is made of a molded dielectric material having a plurality of terminal receiving channels 54 extending the length of the housing. Beneath a front portion of the housing is a locking bar receiving cavity 56, similar to cavity 44 of plug 12, (best seen in FIG. 5) that extends approximately half the length of the housing for receiving the lock bar 52. Cavity 56 has a pair of sidewalls each of which include an aperture 56*a* for receiving the outer edges of a pair of outer, laterally-directed, triangular shaped, resilient material fingers 52*a* of bar 52. Bar 52 also has at least one rectangular shaped finger 52*b* disposed between the pair of outer fingers 52*a*. On a top surface of the housing 48 are the latch bar 36 and the polarity indicator rib 34 mentioned supra. Extending from a rear bottom surface of housing 48 for approximately half the length of the housing are a plurality of resilient material locking keepers 58 which engage a circular grooved slot 50*a* at a chosen location along the body of the female receptacle terminal 50 providing primary locking of the terminal when the terminal is inserted into the receiving channel. Terminal 50 also includes a pair of crimping arms 50*b* attached to a rear end for crimping a wire 51 to terminal 50.

After the terminals 50 are inserted into the receiving channels 54 and are locked in place by the primary locking keepers 58, lock bar 52 is inserted into cavity 56 such that the laterally directed, resilient outer fingers 52*a* of lock bar 52 flex inwardly upon entry into cavity 56 and then flex outwardly when the outer edges of the fingers 52*a* enter the apertures 56*a* in the sidewalls of cavity 56. A top surface of each outer finger 52*a* and center finger 52*b* of lock bar 52 encounters a bottom surface of the corresponding keeper 58 as bar 52 is inserted into cavity 56 to fixedly lock, in a wedge-like manner, each keeper 58 into the slot 50*a* of each female pin terminal 50.

When lock bar 52 is completely inserted, the female pin end of each terminal is encircled by an upright strut 52*c* disposed at a terminating end of bar 52 which has a raised concave-shaped distal end that engages an under portion of the periphery of a collar 50*b* of the pin and mates with the arch-shaped, pin receiving channel 54 in a complimentary fashion so as to prevent wobbly movement of the receptacle end of each terminal when the cable assembly connector and plug are joined.

When lock bars 18 and 52 are used with plug 12 and connector 14 respectively, the secondary locking feature which is provided prevents forceful removal of the terminals. If a terminal has to be replaced, the resilient outer fingers of the locking bars can be manipulated to exit the apertures in the sidewalls without fear of breaking the fingers. The lock bars can be used and reused as often as needed since the structure of the fingers is such that little wear and tear occurs during installation and removal.

While the present invention has been disclosed in connection with the preferred embodiment thereof, it should be understood that there may be other embodiments which fall within the spirit and scope of the invention and that the invention is susceptible to modification, variation and change without departing from the proper scope or fair meaning of the following claims.

What is claimed is:

1. An in-line cable assembly for connecting two separate cable circuits using female receptacle terminals in a connector and male pin terminals in a plug;

wherein a plurality of pin terminals are positioned in a plurality of arch-shaped channels disposed in a housing of the plug;

wherein a plurality of receptacle terminals are positioned in a plurality of arch-shaped channels disposed in a housing of the connector;

wherein each of the plurality of pin and receptacle terminals has a circular grooved slot at a chosen position along the body of the terminal for use in locking the terminal into the housing;

wherein each of the pin and receptacle terminals includes a pair of crimping arms at a rear end for crimping a wire to the terminal;

wherein each of the plurality of channels disposed in the connector housing and the plug housing has a locking keeper arranged therein which snaps into the circular grooved slot of the terminal for providing primary locking of each terminal in each channel to prevent accidental retraction of the terminal during use;

wherein the plug housing is comprised of two molded sections, a front undivided cavity for receiving the connector and a rear divided cavity comprised of the plurality of channels in which the plurality of pin terminals are positioned;

wherein the connector housing is a single section structure having the plurality of channels extending the length of the housing in which the plurality of receptacle terminals are positioned; said cable assembly comprising:

(a) a locking bar receiving cavity disposed under the rear divided cavity of the plug, said cavity having a pair of sidewalls, each of said pair of sidewalls having an aperture extending substantially the length of said sidewalls;

(b) another locking bar receiving cavity disposed under a front portion of the single section cavity of the connector, said another cavity having a pair of sidewalls, each of said pair of sidewalls having an aperture extending substantially the length of said sidewalls;

(c) a male pin terminal secondary locking bar for insertion in said plug receiving cavity, locking each of the plurality of locking keepers in the circular grooved slot of each of the plurality of male pin terminals, said male pin locking bar having a pair of outer laterally directed triangular shaped resilient material locking fingers and at least one rectangular shaped finger disposed between said pair of outer fingers, said outer laterally directed fingers flexing inward upon entry into the receiving cavities and then outward when the outer edges of the outer fingers enter the apertures in the sidewalls of the plug locking bar receiving cavity, said male pin terminal secondary locking bar having a plurality of upright struts disposed at a terminating end of the bar, each of which having a concave-shaped distal end that engages an under portion of the periphery of the pin terminal and mates with the arch-shaped channels in the plug housing in a complimentary fashion so as to prevent wobble movement of the pin end of each terminal when the cable assembly connector and plug are joined, and (d) a female pin terminal secondary locking bar for insertion in said connector receiving cavity under a bottom portion of each of the plurality of locking keepers so as to lock the keepers in the circular grooved slot of each female receptacle terminal, said female pin locking bar having a pair of laterally directed triangular shaped resilient material locking fingers and at least one rectangular shaped finger disposed between said pair of outer fingers, said outer laterally directed fingers flexing inward upon entry into the receiving cavities and apertures in the side walls of the connector locking bar receiving cavity.

2. Assembly of claim 1 wherein said female receptacle terminal secondary locking bar has a plurality of upright struts disposed at a terminating end of the bar, each of which having a concave-shaped distal end that engages an under portion of a collar of the receptacle terminal and mates with the arch-shaped, channels in the connector housing in a complimentary fashion so as to prevent wobbly movement of the receptacle end of each terminal when the cable assembly connector and plug are joined.

* * * * *